US010173836B2

(12) United States Patent
Schuur

(10) Patent No.: US 10,173,836 B2
(45) Date of Patent: Jan. 8, 2019

(54) DEVICE FOR PLACING AND HOLDING SOILED ITEMS THEREIN

(71) Applicant: SANALIFE B.V., Gorssel (NL)

(72) Inventor: Theodoor Jacobus Robert Schuur, Delft (NL)

(73) Assignee: SANALIFE B.V., Gorssel (NL)

( * ) Notice: Subject to any disclaimer, the term of this patent is extended or adjusted under 35 U.S.C. 154(b) by 5 days.

(21) Appl. No.: 15/507,325

(22) PCT Filed: Aug. 10, 2015

(86) PCT No.: PCT/NL2015/050570

§ 371 (c)(1),
(2) Date: Feb. 28, 2017

(87) PCT Pub. No.: WO2016/036239

PCT Pub. Date: Mar. 10, 2016

(65) Prior Publication Data

US 2017/0240353 A1 Aug. 24, 2017

(30) Foreign Application Priority Data

Sep. 7, 2014 (NL) ..... 1040939

(51) Int. Cl.
*B65F 1/14* (2006.01)
*B65F 1/10* (2006.01)
(Continued)

(52) U.S. Cl.
CPC ..... *B65F 1/10* (2013.01); *B65F 1/06* (2013.01); *B65F 1/1607* (2013.01);
(Continued)

(58) Field of Classification Search
CPC .. B65F 1/05; B65F 1/10; B65F 1/1607; B65F 1/1615; B65F 2240/132; B65F 2001/1676; B65F 1/06; B65F 2001/1692
(Continued)

(56) References Cited

U.S. PATENT DOCUMENTS

2015/0232268 A1* 8/2015 Garland ..... B65F 1/1607 220/495.05

FOREIGN PATENT DOCUMENTS

| | | |
|---|---|---|
| EP | 0776305 B2 | 6/1997 |
| WO | 2008030997 A2 | 3/2008 |
| WO | 2014035249 A1 | 3/2014 |

OTHER PUBLICATIONS

International Preliminary Report on Patentability dated Mar. 7, 2017 for PCT application PCT/NL2015/050570 filed Aug. 10, 2015.
(Continued)

*Primary Examiner* — Fenn C Mathew
*Assistant Examiner* — Elizabeth J Volz

(57) ABSTRACT

A device (1) for placing and holding soiled items, in particular soiled items such as soiled diapers, therein, comprising a container (2) and a lid (3), wherein the lid (3) includes a hollow cylinder (5), which is open at least at one end (4), in which cylinder (5) a body (6) is capable of reciprocal motion, wherein the lid (3) can pivot relative to the container (2) between a first position, in which an Item can be inserted into the cylinder (5) from outside; and a second position, in which the body (6) can move downward in the cylinder (5) under the influence of the force of gravity so as to push the item into the container (2), and wherein the device (1) is provided with a locking device (12) for locking the lid (3) in the second position.

9 Claims, 7 Drawing Sheets

(51) Int. Cl.
*B65F 1/06* (2006.01)
*B65F 1/16* (2006.01)

(52) U.S. Cl.
CPC .... *B65F 1/1615* (2013.01); *B65F 2001/1692* (2013.01); *B65F 2240/132* (2013.01)

(58) Field of Classification Search
USPC .... 220/212.5, 254.8, 253, 262, 318, 495.06, 220/495.08, 495.07, 908, 908.1, 908.3, 220/315, 495.05
See application file for complete search history.

(56) References Cited

OTHER PUBLICATIONS

ISR and Written Opinion dated Oct. 3, 2016 in corresponding International Patent Application No. PCT/NL2015/050570.

* cited by examiner

DEVICE FOR PLACING AND HOLDING SOILED ITEMS THEREIN

The present invention relates to a device for placing and holding soiled items, in particular soiled items such as soiled diapers, therein, comprising a container and a lid, wherein the lid includes a hollow cylinder, which is open at least at one end, in which cylinder a body is capable of reciprocal motion, wherein the lid can pivot relative to the container between a first position, in which an item can be inserted into the cylinder from outside, and a second position, in which the body can move downward in the cylinder under the influence of the force of gravity so as to push the item into the container. It is noted that the term "diapers" is understood to include not only baby diapers but also incontinence diapers, in particular for adults, as well sanitary products for women.

Such a device is known from European patent No. 0 776 305 of the present applicant. In the known device, the lid forms a one-way valve, wherein the body is configured as a piston which is capable of reciprocal motion within the cylinder. When the lid of the known device is in the first position, items can be placed into the cylinder and subsequently the lid can be pivoted to the second position. The piston moves down under the influence of the force of gravity so as to thus push the items into the container. The lid described in the aforesaid European patent specification has two open ends, so that items can be placed into the cylinder both in the first position and in the second position. Rubber 0-rings provide an odor and liquid tight seal.

The fact that the device known from the aforesaid European patent leaves room for improvement as regards safety is in some cases felt to be a drawback in practice.

The object of the invention is to improve a device known from the prior art and in order to achieve that object a device of the kind described in the introduction is according to the invention characterised in that the device is provided with a locking device for locking the lid in the second position. The locking device in particular comprises an operating element which is movable between a retracted position, in which the lid is locked in the second position, and an extended position, in which the lid is released in the second position. This makes it possible to prevent children from opening the lid with their hands and subsequently getting stuck between the container and the lid with their hand(s).

In a preferred embodiment of a device according to the invention, the lid is provided with two opposite cams, which are rotatably provided in correspondingly shaped recesses of the container, wherein the cams define a pivot axis for pivoting the lid between the first and the second position relative to the container, and wherein the operating element prevents rotation of at least one of the cams in the retracted position and allows such rotation in the extended position. The operating element is preferably configured as a U-shaped operating handle, wherein each leg of the U-shape prevents rotation of a corresponding cam in the retracted position and allows such rotation in the extended position.

In another preferred embodiment of a device according to the invention, the container comprises an upper part provided with an opening, wherein the opening in the upper part connects to the open end of the cylinder in the second position of the lid so as to make it possible to push the item from the cylinder, through the opening in the upper part, into the container. The upper part preferably comprises a recessed portion for at least partially accommodating the lid therein, wherein a side wall of the upper part includes the recesses for rotatably providing the cams of the lid therein.

A wall of the upper part is in that case in particular provided with an opening for receiving the operating handle.

In another preferred embodiment of a device according to the invention, the opening in the upper part is provided with a seal along its circumferential edge. The seal is preferably made up of a sealing ring which is installed in a correspondingly shaped recess in an upper wall of the upper part. The sealing ring is preferably removably provided in the recess.

The invention will now be explained in more detail with reference to figures illustrated in a drawing, in which.

Figure 1:
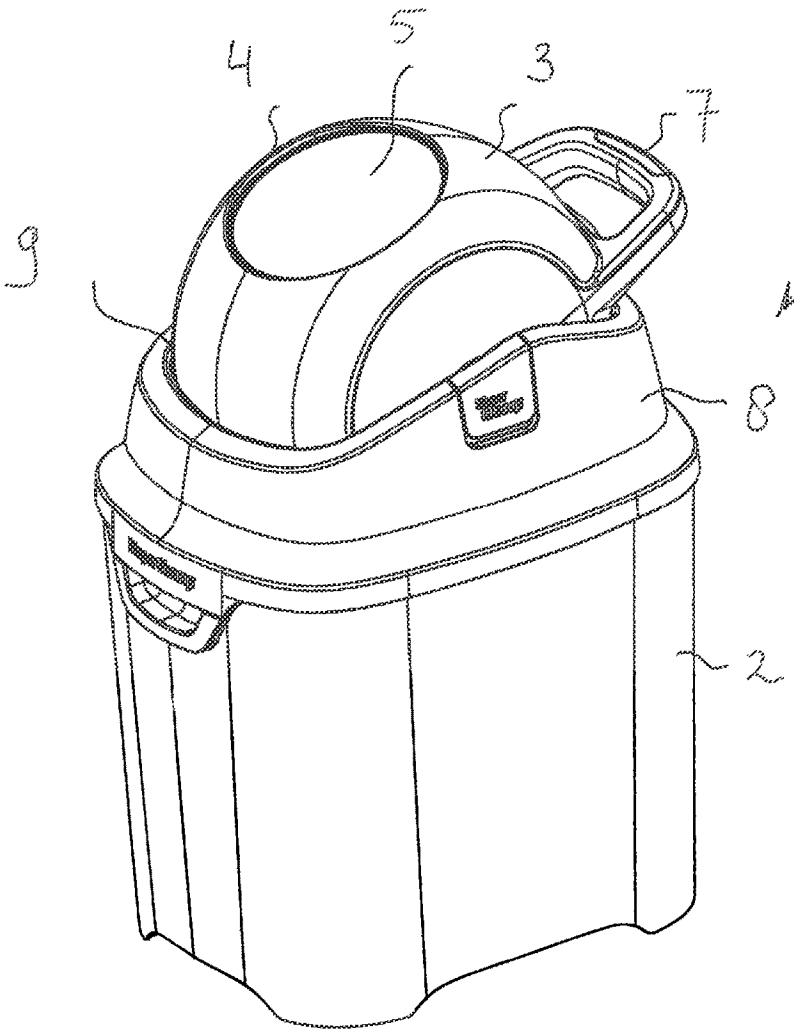
FIG. 1 is a schematic, perspective view of a preferred variant of a device according to the invention.
Figure 2:
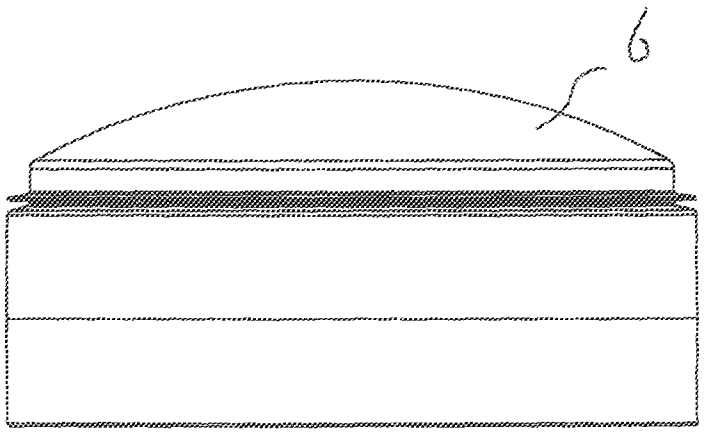
FIG. 2 is a side view of a part of the device of FIG. 1.
Figure 3A:
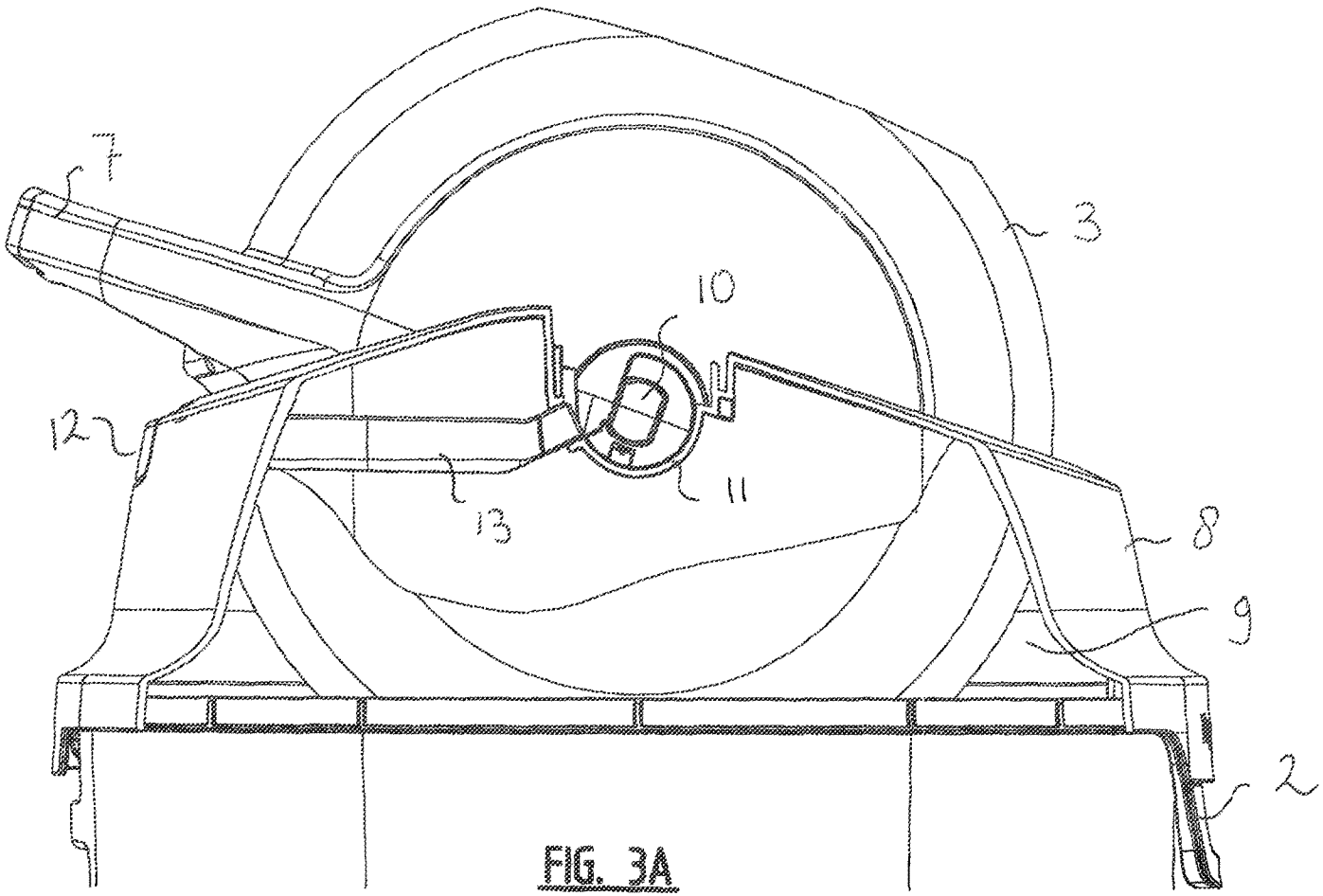
Figure 3B:
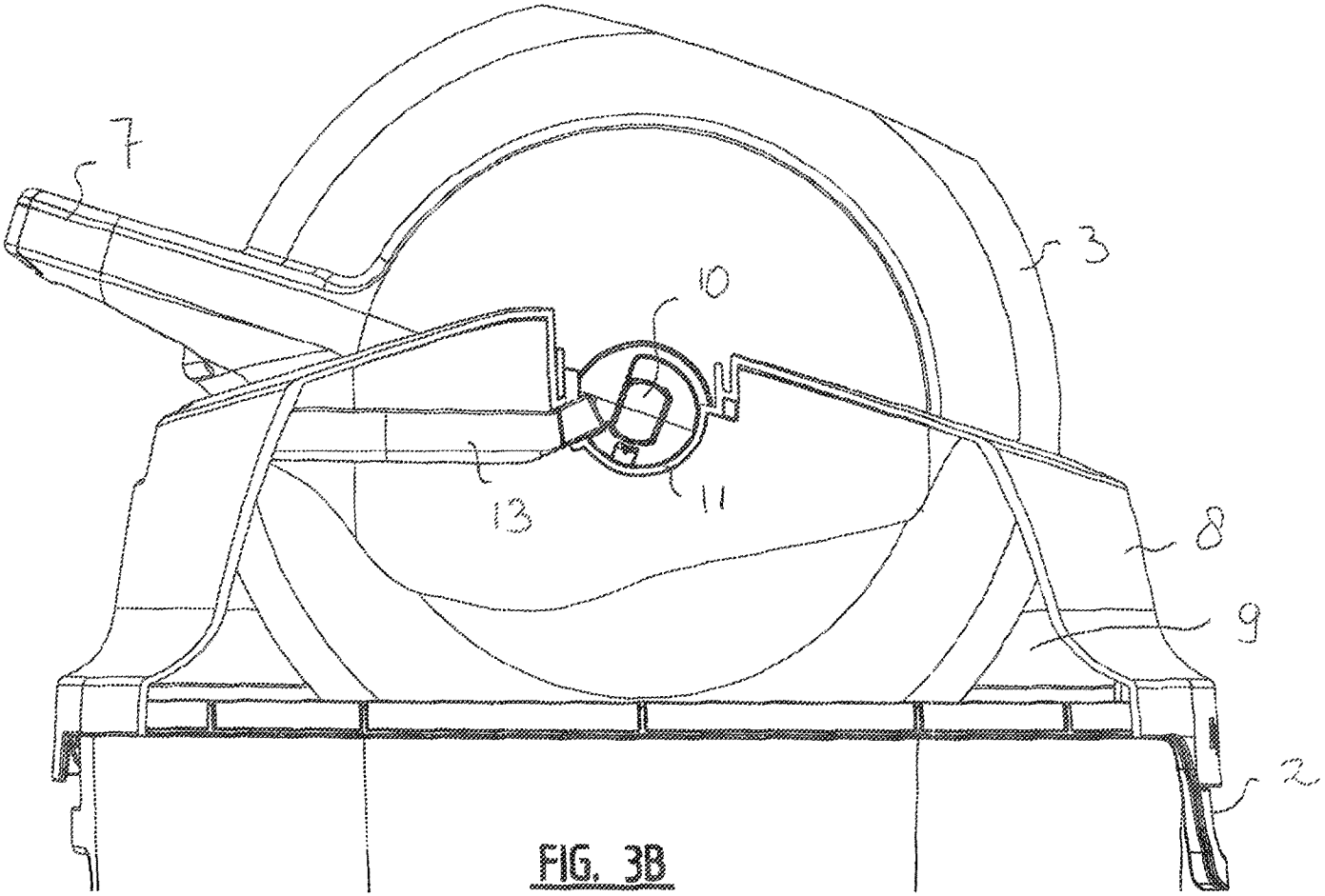
Figure 4:
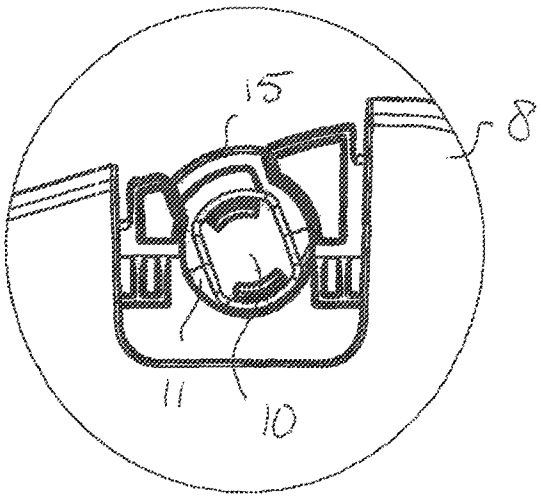
Figure 4:
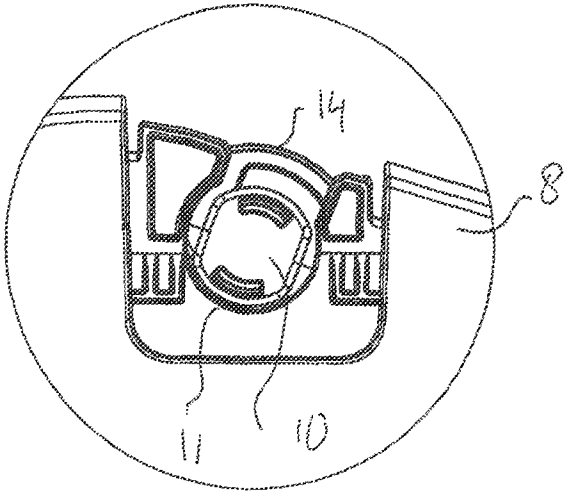
Figure 5:
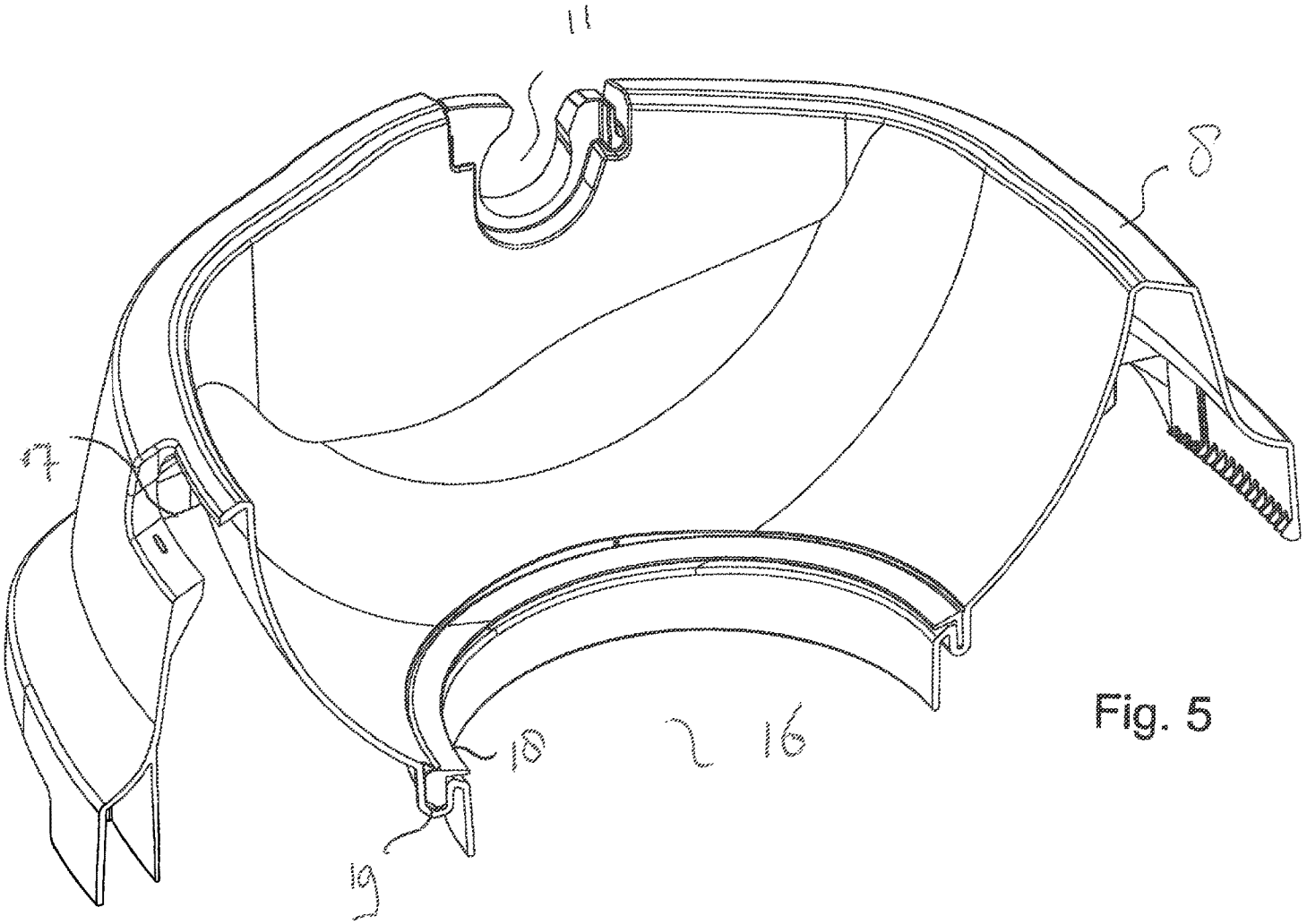
Figure 6:
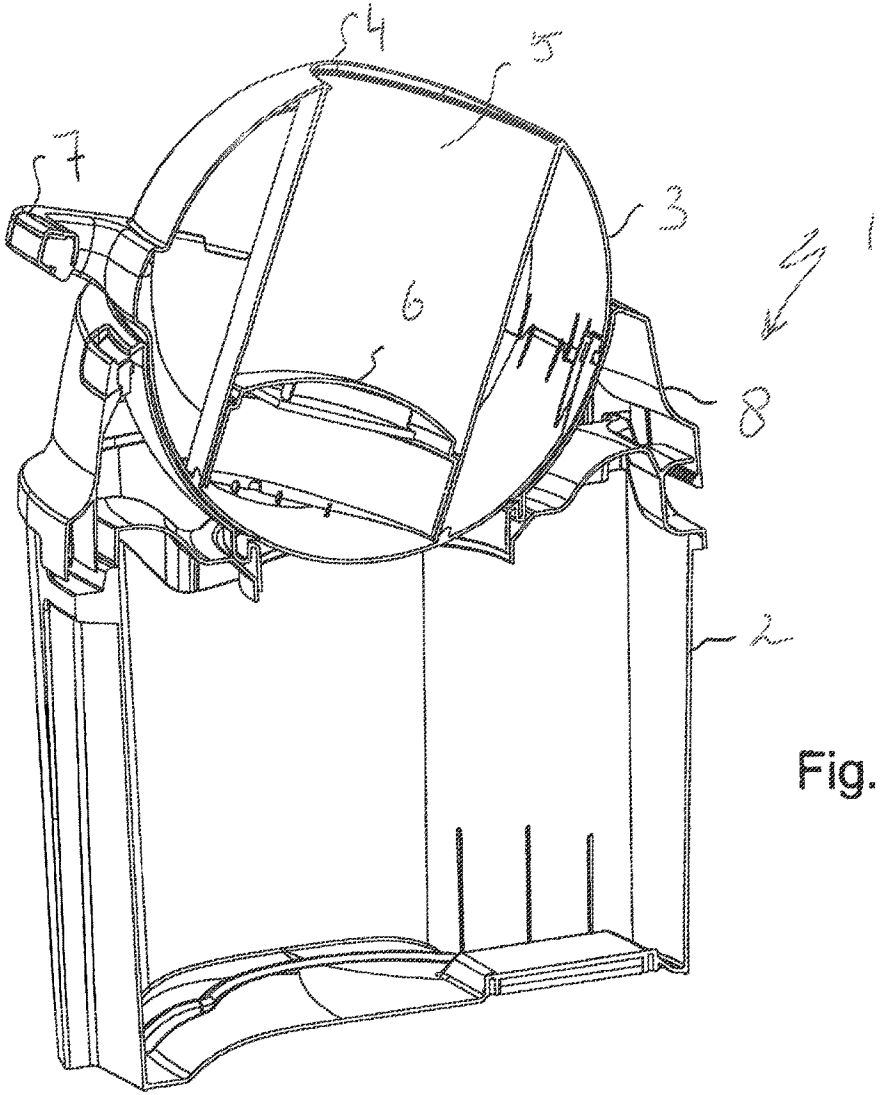

FIGS. 3*a* and 3*b* are partial cross-sectional views showing steps of the operation of a locking device of the device shown in FIGS. 1 and 2;

FIG. 4 is a schematic side view showing details of the device of FIGS. 1, 2 and 3;

FIG. 5 is a schematic, perspective view of a detail of the device of FIGS. 1, 2 and 3; and FIG. 6 corresponds to FIG. 1, but in this case the device is shown in cutaway view.

FIG. 1 shows a device 1 made of plastic material for placing and holding soiled items, in particular soiled diapers, (not shown) therein, comprising a container 2 and a lid 3. The container 2 may be made up of several seconds mounted on top of one another, with the lowermost segment also forming the bottom of the container 2. The lid 3 is provided with a hollow cylinder 5 which is open at one end 4, in which a disc 6 is capable of reciprocal motion, as will be explained in more detail yet with reference to FIG. 2. The lid 3 can be manually pivoted, using a handle 7, about a pivot axis relative to the container 2, or in other words, be pivoted from a first position, in which a soiled diaper can be inserted into the cylinder 5, to a second position, in which the disc 7 can slide downward into the cylinder 5 under the influence of the force of gravity, and vice versa, so as to push the soiled diaper into the container 2.

With reference to FIGS. 1, 3*a* and 3*b*, the container 2 may be configured as a support for a bag of a flexible material, such as a garbage bag or a pedal bin bag for holding soiled diapers therein. The bag can be exchanged after some time. The container 2 comprises an upper part 8 provided with an opening which, in the second position of the lid 3, connects to the open end 4 of the cylinder 5 so as to make it possible to push the item from the cylinder 5, through the opening in the upper part 8, into the container 2. As shown, the upper part 8 comprises a recessed portion 9 for at least partially accommodating the lid 3. The lid 3 is provided with laterally extending projections or cams 10 on either side thereof, which cams can be placed in correspondingly shaped recesses 11 in the upper part 8 of the container 2. The cams 11 form bearings, as it were, for pivoting the lid 3 between the aforesaid first and second position.

FIGS. 3*a* and 3*b* show the operation of a locking device 12 for locking the lid 3 in the second position. As shown, the locking device 12 is formed by a U-shaped operating handle, which can be moved between a retracted position, in which the lid 3 is locked in the second position, and an extended position, in which the lid 3 is released in the second position. More in particular, each leg 13 of the U-shape prevents rotation of a corresponding cam 10 of the lid 3 by engaging said cam in the retracted position (FIG. 3*b*), and each leg 13 of the U-shape allows rotation of a corresponding cam 10 of the lid 3 by moving clear thereof in the extended position (FIG. 3*a*).

FIG. 4 shows (seen from the left to right) a left-hand side view and a right-hand side view of the mating cams 10 and recesses 11, wherein caps 14, 15 differing in width are provided. This achieves that the upper part 8 cannot be installed wrong side.

FIG. 5 clearly shows that the upper part 8 comprises an opening 16, wherein the opening 16 in the upper part 8 connects to the open end 4 of the cylinder 5 in the second position of the lid 3 so as to make it possible to push the item from the cylinder 5, through the opening 16 in the upper part 8, into the container 2. The upper part 8 further comprises the recessed portion 9 for at least partially accommodating the lid 3. As shown, a side wall of the upper part 8 comprises the recesses 11 in which the cams 10 of the lid 3 can be rotatably provided. The figure further shows that the wall of the upper part 8 is provided with an opening 17 for receiving the operating handle. The opening 16 in the upper part 8 is provided with a removable sealing ring 18 along its circumferential edge, which sealing ring is provided in a correspondingly shaped recess 19 in a bottom wall of the upper part 8.

FIG. 6 corresponds to FIG. 1, but in this case the device is shown in cutaway view.

It is noted that the invention is not limited to the embodiment as shown and described herein, but that it also extends to other preferred variants that fall within the scope of the appended claims.

The invention claimed is:

1. A device for placing and holding soiled items, therein, comprising:

a container and a lid, wherein the lid includes a hollow cylinder which is open at least at one end such that a body is capable of reciprocal motion within the hollow cylinder, wherein the lid can pivot relative to the container between a first position, in which an item can be inserted into the hollow cylinder from outside, and a second position, in which the body can move downward in the hollow cylinder under the influence of the force of gravity so as to push the item into the container, wherein the device is provided with a locking device for locking the lid in the second position, wherein the locking device comprises an operating element which is movable between a retracted position, in which the lid is locked in the second position, and an extended position, in which the lid is released in the second position, and wherein the lid is provided with two opposite cams which are rotatably provided in correspondingly shaped recesses of the container, wherein the cams define a pivot axis for pivoting the lid between the first and the second position relative to the container, and wherein the operating element prevents rotation of at least one of the cams in the retracted position and allows such rotation in the extended position.

2. The device according to claim 1, wherein the soiled items comprise soiled diapers.

3. The device according to claim 1, wherein the operating element is configured as a U-shaped operating handle, and wherein each leg of the U-shape prevents rotation of a corresponding cam in the retracted position and allows such rotation in the extended position.

4. The device according to claim 3, wherein the container comprises an upper part provided with an opening, wherein the opening in the upper part connects to the open end of the hollow cylinder in the second position of the lid so as to make it possible to push the item from the hollow cylinder, through the opening in the upper part, into the container.

5. The device according to claim 4, wherein the upper part comprises a recessed portion for at least partially accommodating the lid therein, and wherein a side wall of the upper part includes the recesses for rotatably providing the cams of the lid therein.

6. The device according to claim 4, wherein a wall of the upper part is provided with an opening for receiving the operating handle.

7. The device according to claim 6, wherein the opening in the upper part is provided with a seal along its circumferential edge.

8. The device according to claim 7, wherein the seal is made up of a sealing ring which is installed in a correspondingly shaped recess in an upper wall of the upper part.

9. The device according to claim 8, wherein the sealing ring is removably provided in the recess.

* * * * *